US005083955A

United States Patent [19]

Echols

[11] Patent Number: 5,083,955

[45] Date of Patent: Jan. 28, 1992

[54] AQUATIC RECREATIONAL TOWING DEVICES

[76] Inventor: Donald G. Echols, 6035 Dogwood Dr., Lincoln, Nebr. 68510

[21] Appl. No.: 420,178

[22] Filed: Oct. 11, 1989

[51] Int. Cl.[5] ..... A63C 5/00

[52] U.S. Cl. ..... 441/65; 441/69; 114/253

[58] Field of Search ..... 114/253; 441/65, 66, 441/67, 68, 69, 71

[56] References Cited

U.S. PATENT DOCUMENTS

| | | | |
|---|---|---|---|
| 2,946,305 | 7/1960 | Hill | 441/68 |
| 3,142,075 | 7/1964 | Hill | 441/68 |
| 3,227,126 | 1/1966 | Etzler | 441/69 |
| 3,380,425 | 4/1968 | Wilson | 441/65 |
| 3,435,471 | 4/1969 | Drennen | 441/65 |
| 3,824,945 | 7/1974 | Casciano | 114/253 |
| 4,678,444 | 7/1987 | Monreal | 441/65 |

FOREIGN PATENT DOCUMENTS

| | | | |
|---|---|---|---|
| 1169 | 3/1979 | European Pat. Off. | 114/253 |
| 2571268 | 4/1986 | France | 441/71 |

*Primary Examiner*—Joseph F. Peters, Jr.
*Assistant Examiner*—Stephen P. Avila
*Attorney, Agent, or Firm*—James F. Duffy

[57] ABSTRACT

Apparatus for exerting a towing force on an aquatic recreational towing device in the initial stages of towing the device while a rider thereon positions himself for purposes of riding on and maneuvering the device as it is drawn over a water surface at high speed by a towing boat. The tow rope running between the towing boat and the towed device is coupled directly to the device in a manner which readily permits the rider to decouple the towing force from its direct application to the towing device and to interpose the rider between the tow rope and the towed device as an intermediary for transmitting towing forces from the tow boat to the towed device.

9 Claims, 2 Drawing Sheets

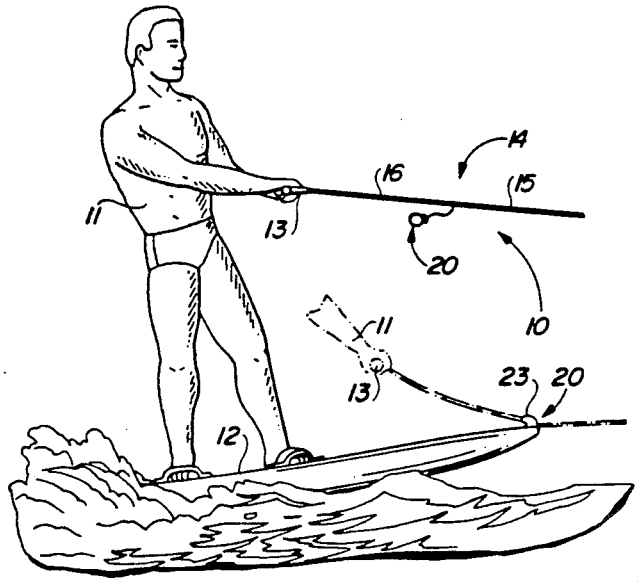
FIG. 1
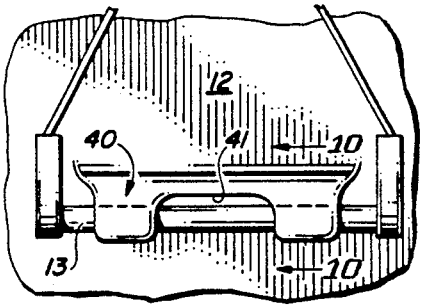
FIG. 9
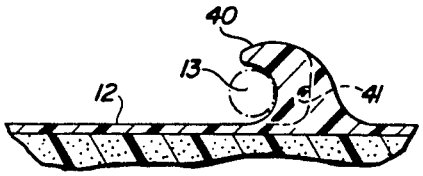
FIG. 10
FIG. 8
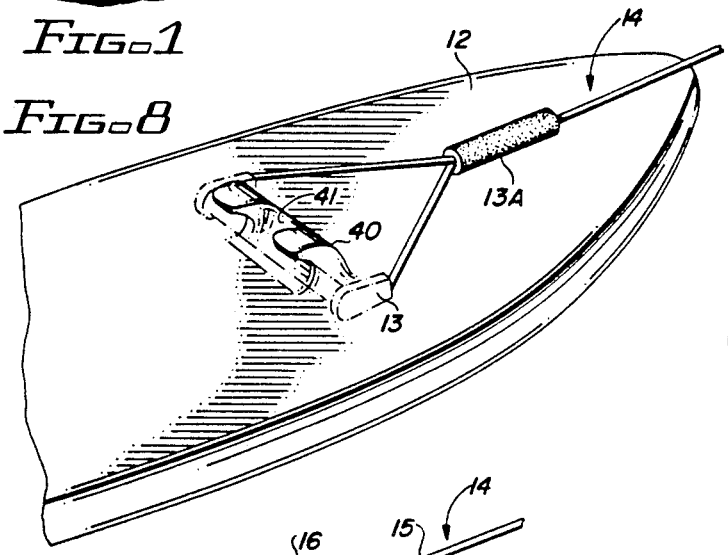
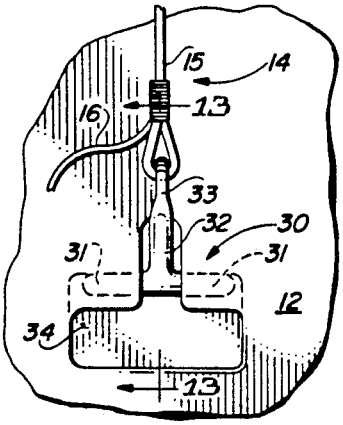
FIG. 12
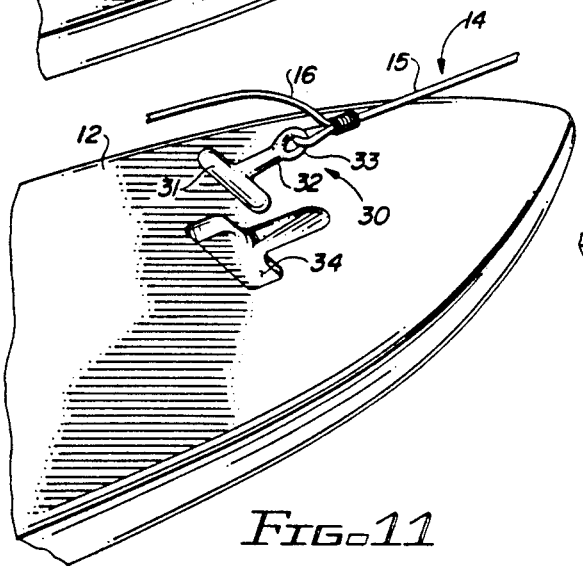
FIG. 11
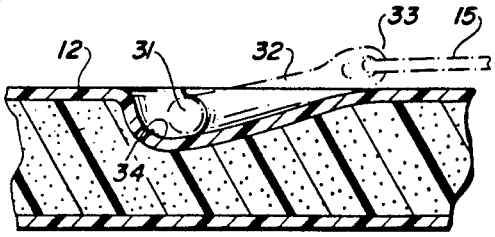
FIG. 13

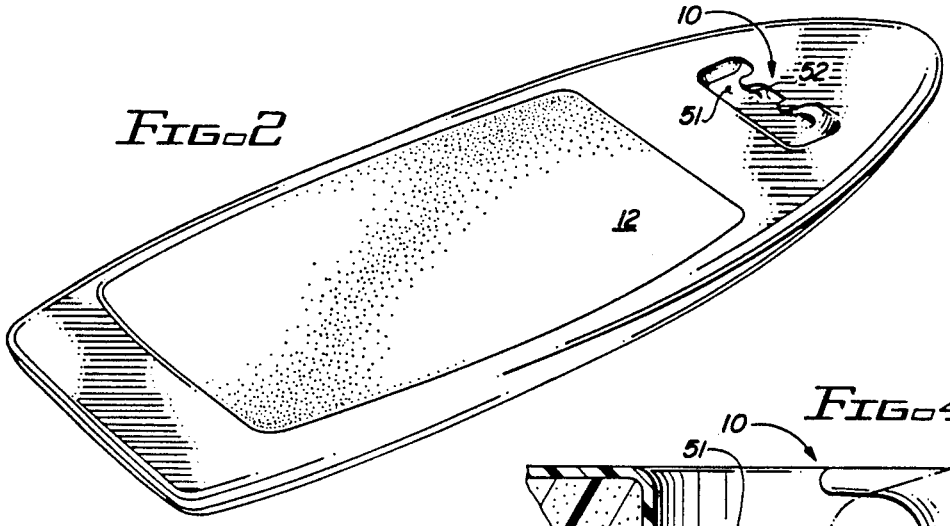
FIG. 2
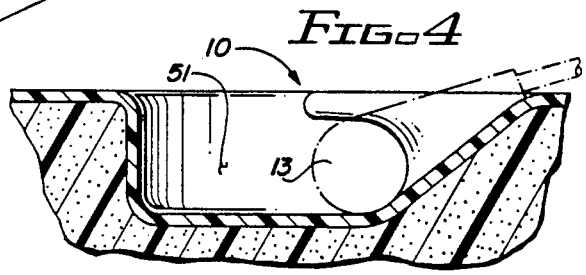
FIG. 4
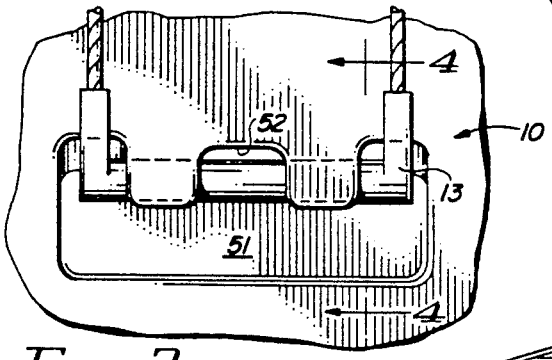
FIG. 3
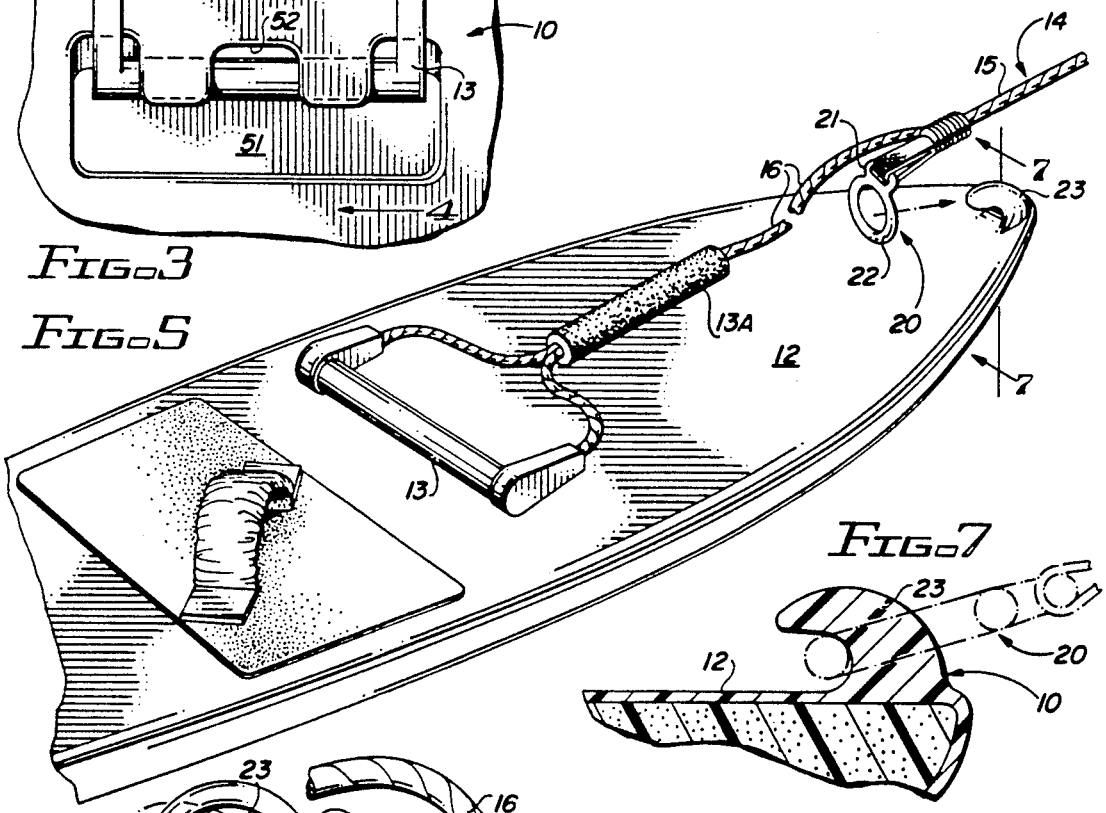
FIG. 5
FIG. 7
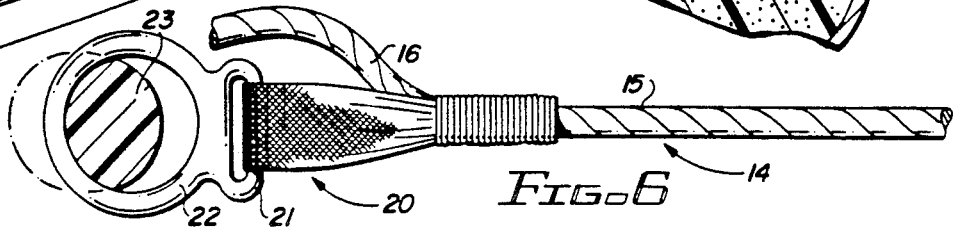
FIG. 6

AQUATIC RECREATIONAL TOWING DEVICES

BACKGROUND

1. Field of the Invention

The invention relates to an aquatic recreational system in which a rider mounts and rides an aquatic towing device while being towed behind a tow boat. Such aquatic towing devices will include a knee board on which a rider kneels while being towed and a ski board on which a rider stands while being towed. The invention relates to improvements in such towing devices to make it easier for a rider to initiate the towing and positioning of such devices preparatory to riding and maneuvering them.

2. Prior Art

To watch someone skimming across the surface of the water, towed behind a fast moving boat while riding on water skis, a knee board, or a ski board can engender feelings of excitement and envy. It all seems so very easy to hold a tow rope handle and to allow oneself to be drawn along the water surface skipping over wavelets and the boat's wake. However, what one often misses seeing is the difficulty the towed rider has in initiating the ride by positioning himself on board the towed device as the tow boat begins to draw the rider and the towed device into motion.

To watch one rise up on water skis seems a relatively easy task. One rests in the water with hands on the tow rope, the tips of the skis pointing skyward. The boat begins to move and accelerates. The tips of the skis move downward toward the water as the rider rises upward out of the water. Soon the skis are planing over the surface and the rider is free to maneuver the skis to the extent of his acquired abilities to do so. Other towing devices provide the rider with a greater challenge in positioning the device during the initial phases of the towing operation.

A ski board is an aquatic towing device having a pair of stirrups for the rider's feet. As the rider rides the ski board, his forward foot is positioned at an angle approximately 45° F. to the longitudinal axis of the ski board. His other foot is positioned at an angle approximately transverse to that axis. At the beginning of the ride, the rider lies in the water, his feet in the stirrups of the ski board, and the longitudinal axis of the ski board lies transverse to the direction in which the tow boat begins to move. As the boat gains momentum, the rider must rise from the water and do so while maneuvering the ski board to bring it into a planning position with its longitudinal axis generally parallel to the direction of movement of the tow boat. The skill and strength of the rider, in these initial phases of rising up on the ski board and positioning the ski board for maneuvering exercises, may require more strength and capability than is demanded of the same rider in initiating the early stages of riding on water skis. This is true because much of the rider's energy must be transmitted through his legs to maneuver the ski board into the appropriate riding position while the hands and arms are engaged in holding tightly to the handle of the tow rope so as to permit the tow boat to bring the rider and the ski board into motion.

A knee board is another aquatic planing device which is towed behind a moving boat. Unlike the ski board on which a rider rides while standing with feet in stirrups, the knee board is ridden while the rider kneels on the board. To maintain the rider on board the knee board, and to permit the maneuvering of the board without separating the rider from the board, a strap is utilized which passes over the thighs of the rider to aid in preventing his separation from the board. This strap must be positioned and adjusted after the knee board has been drawn into motion by movement of the towing boat.

To initiate the ride on a knee board, the rider holds the handle of the tow rope with one or both hands while lying generally prone on the knee board, holding the knee board with one or both hands. As the tow boat begins to move, the rider must maintain hold of both the tow rope handle and the tow board. As the tow board begins to plane, the rider positions himself on his knees, atop the board and adjusts the strap across his thighs to maintain himself in contact with the board. All this while holding on to the handle of the tow rope. Eventually, with straps secure, the rider signals the tow boat to accelerate and the fun begins.

As can be seen, the necessity to hold on to the tow rope handle while positioning oneself and the towing device can present a difficult challenge to persons attempting to ride either a ski board or a knee board. It is the intent of this invention to provide improvements in such aquatic towing devices as to ease that challenge and to allow a rider to more readily initiate and complete the early maneuvers necessary for riding a ski board, a knee board, or the like.

SUMMARY OF THE INVENTION

The invention is disclosed and claimed as an improvement in aquatic recreational towing systems. The system to be improved is one in which a rider holds a tow rope handle and is towed, via a tow rope, through water by a tow boat while mounting an aquatic towing device. As the rider is towed, he rises to a riding and maneuvering position on the towing device as the tow boat gains in speed. The improvement is disclosed as comprising releasable coupling means for coupling the tow rope to the towing device whereby the towing device is towed directly by the tow boat without intervention of the rider until the rider assumes tow rope handle control by releasing the coupling between the tow rope and the towing device. In an embodiment of the invention disclosed, the releasable coupling means comprises a tow rope handle-retaining-means coupled to the towing device for releasedly retaining the tow rope handle in direct towing contact with the towing device.

In a preferred embodiment of the invention, the tow rope handle-retaining-means comprises a recess in the towing device. The recess has a shape which is complementary to that of the tow rope handle. The tow rope handle is at least partially, matingly retained within that recess in direct, releasable towing contact with the towing device.

In another embodiment of the invention, the releasable coupling means is shown to comprise a first tow-rope-retaining-means coupled to the towing device. There is a second tow-rope-retaining-means which is coupled to the tow rope itself, proximate the tow rope handle. This second tow-rope-retaining-means makes a releasable coupling with the first tow-rope-retaining-means.

In one of the embodiments disclosed, the first tow-rope-retaining-means is a ring-captivating device for releasedly mating with a ring-shaped object and the second tow-rope-retaining-means is that ring-shaped object.

Alternatively, the first tow-rope-retaining-means comprises a selectedly shaped key recess in the towing device. The second tow-rope-retaining-means then comprises a selectedly shaped key of complementary shape to that of the key recess. This key is emplacable within the key recess to be releasedly retained therein. In an embodiment of the invention disclosed herein, the key recess is a tee-shaped recess and the key is a tee-shaped key.

DESCRIPTION OF THE DRAWINGS

FIG. 1 illustrates a rider riding a ski board and holding the handle of a tow rope. In phantom outline, the position of the rider's hands in the initial phases of the ride is illustrated indicating the tow rope coupled directly to the ski board.

FIG. 2 illustrates a knee board having a recessed keyway for receiving the handle of a tow rope so that the initial towing forces are communicated directly to the knee board rather than through the hands of the rider.

FIG. 3 is a detail of the tow rope handle emplaced within the recessed keyway of the knee board of FIG. 2.

FIG. 4 is a sectional view along the lines 4—4 of FIG. 3 showing the manner in which the tow rope handle is accepted within the recessed keyway.

FIG. 5 illustrates a ski board having means coupled thereto for engaging a ring positioned on the tow rope adjacent the two rope handle.

FIGS. 6 and 7 present top and side sectional views of the ring of FIG. 5 coupled to the ring engaging means of the ski board.

FIG. 8 is a perspective view of a portion of a knee board illustrating surface mounted means for engaging the handle of the tow rope.

FIG. 9 is a top detailed view of the surface mounted engaging means of FIG. 8.

FIG. 10 is a side sectional view along line 10—10 of FIG. 9.

FIG. 11 illustrates a recessed keyway in the surface of a towing device and a key, of complementary shape to the keyway, affixed to the tow rope.

FIG. 12 is a top detail view of the key emplaced within the keyway of FIG. 11.

FIG. 13 is a side sectional view taken along line 13—13 of FIG. 12 showing the key retained within the embrace of the recessed keyway.

A DETAILED DESCRIPTION OF THE INVENTION

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as disclosed herein, as would normally occur to one skilled in the art to which the invention pertains.

It is the intent of the invention that much of the stress encountered by a rider attempting to hold a tow rope handle against the force of a moving tow boat while maneuvering an aquatic towing device into position to initiate a ride thereon shall be eliminated by transferring the initial towing forces directly to the towing device thereby eliminating stress induced in the hands and arms of the rider as the ride begins. In FIG. 1, a rider 11 is seen astride a ski board 13 which is planing across the surface of a body of water in response to towing forces transmitted through a towing rope 14 from a tow boat, not illustrated, to tow rope handle 13 held by rider 11. Tow rope 14 is illustrated as being comprised of two sections, the major section 15 and a short section 16. The short section 16 of tow rope 14 is defined as that length between tow rope handle 13 and the point of attachment to tow rope 14 of ski board coupling ring 20. Ski board coupling ring 20 is utilized in the initial phases of instilling motion into ski board 12.

During the initial phases of bringing ski board 12 into motion, the situation illustrated in phantom outline exists. Coupling ring 20 is engaged with ring engaging means 23 at the prow of ski board 12. Towing forces are transmitted through major portion 15 of tow rope 14. These towing forces bring ski board 12 into motion directed along the path of the tow boat. The rider 11 holds tow rope handle 13 exerting only such forces on that portion 16 of tow rope 14 as will enable rider 11 to stabilize himself aboard ski board 12 as he rises to the normal riding position on the ski board. By exerting additional force on that portion 16 of tow rope 14, the rider will cause ski board 12 to move slightly forward so as to decouple ring 20 from ring engaging means 23 and to transfer the towing forces from ski board 12 to the hands of the rider 11 holding tow rope handle 13. The general concept of releasable tow coupling means will be disclosed in greater detail in the remaining drawings.

The ski board of FIG. 1 is shown in greater detail in FIG. 5. Ring engaging means 23 is a hook-like structure coupled to the prow of ski board 12. Ring engaging means 23 may be molded into the board at the time of its manufacture or may be later coupled to the surface of ski board 12 by chemical welding or the like. The shape of ring engaging means 23, shown in greater detail in FIGS. 6 and 7, is designed to releasedly couple with ring 20 which is affixed to tow line 14 separated a short distance from tow handle 13 by a relatively short length of tow rope 16.

The exact shape of ring 20 is immaterial so long as it will readily engage and disengage with ring engaging means 23. In the exemplary illustrations herein, ring 20 is conceived as comprising an annulus 22 which releasedly couples with ring engaging means 23 in the manner illustrated in FIGS. 6 and 7, and which further comprises a smaller slotted opening 21 to facilitate attachment of ring 20 to tow rope 14.

Reference to FIGS. 1, 5 and 7 will make clear the manner in which this embodiment of the invention works. In the cross sectional view of FIG. 7, taken along line 7—7 of FIG. 5, ring 20 is engaged with ring engaging means 23 so that a towing force applied to tow rope 14 by a towing boat will cause ski board 12 to move forward in the water. This towing force applied through tow rope 14 to the prow of ski board 12 draws the ski board into alignment with the path of direction of motion of the tow boat. The rider 11 may hold tow handle 13, applying only minor stress to the short length 16 of tow rope 14 as the rider stabilizes himself and begins to rise to the conventional riding position. When the rider is ready to decouple ring 20 from ring engaging means 23, he exerts a greater pull on tow rope handle 13. This force exerted on tow rope handle 13 causes both the rider 11 and ski board 12 to advance in the direction of the towing boat. As ski board 12 advances toward the boat, ring 20 disengages from ring engaging means 23. The towing forces then are transmitted through tow rope 14 directly to the rider 11 via tow rope handle 13.

An alternate embodiment of the invention is illustrated in FIGS. 11, 12 and 13. In the embodiment just disclosed, ring engaging means 23 projected above the surface of ski board 12. To present a more streamlined appearance and eliminate any projections above the surface of the ski board, a configuration utilizing a recessed keyway is now presented.

In FIG. 11, a keyway 34 is recessed into ski board 12. Keyway 34 has a selected shape. In the illustrated embodiment the shape is that of a tee. A key 30 has a shape complementary to that of keyway 34 so that it may couple within the recess 34, retained there by the forces transmitted in the course of towing ski board 12 and readily released therefrom when desired by the rider. As seen in FIG. 11, key 30 is tee shaped, having a cross tang 31 orthogonal to shaft 32. An opening 33, at the distal end of shaft 32, is provided for conveniently affixing key 30 to tow rope 14. As with ring 20, key 30 is affixed to tow rope 14 by a relatively short length 16 of tow rope.

In FIGS. 12 and 13, key 30 is seen engaged within recess keyway 34. A towing force exerted along major length 15 of towing rope 14 will be transmitted directly to ski board 12 when key 30 is engaged within keyway 34 in the manner illustrated in FIGS. 12 and 13. FIG. 13 is a side sectional view along lines 13—13 of FIG. 12.

As earlier explained, with respect to towing ring 20, when the skier draws back on handle 13 to exert a force on minor length 16 of tow rope 14, ski board 12 will advance forward in the direction of the tow boat causing key 30 to rotate backwards toward the rider and disengage from keyway 34. Thereafter the towing forces are transmitted directly to the rider 11 who is holding tow rope handle 13 which is connected directly to the tow boat by means of tow rope 14.

Instead of using a towing ring 20 or a towing key 30 to directly couple the towing forces to the towing device, it may be desirable to utilize towing handle 13 for this purpose.

In the remaining figures, towing device 12 is configured as a knee board. In FIG. 8, tow handle retaining means 40 is surface mounted to the knee board 12. FIGS. 9 and 10 illustrate in greater detail the manner in which handle 13 is engaged and retained by handle retaining means 40. FIG. 10 is a side sectional view through line 10—10 of FIG. 9. A person attempting to ride knee board 12 of FIG. 8 will engage tow rope handle 13 with handle retaining means 40 and will lie atop board 12 as the tow boat begins to move. Towing forces are exerted on board 12 via tow rope 14. Board 12 moves forward through the water as the tow boat moves. The rider has merely to hold on to board 12 as the board moves forward in the water and rises to the surface.

With the towing forces being applied directly to board 12 via handle 13 and handle retaining means 40, the rider is not hampered by having to hold handle 13 while fastening himself to the knee board by means of the straps, not illustrated, conventionally utilized with knee boards.

When the rider has positioned himself for maneuvering of board 12 and has the necessary straps in place and adjusted, he may reach forward and grasp foam tubing 13A, which provides a convenient means for grasping tow rope 14, and, exerting a pulling force on tow rope 14, cause board 12 to move forward sufficiently to disengage tow rope handle 13 from handle retaining means 40. Alternatively, a finger clearance cutout 41 may be incorporated in tow handle retaining means 40 so that the rider may insert his fingers within cutout 41 to immediately grasp tow handle 13, exert a pulling force on handle 13 and so disengage it from retainer 40.

As earlier suggested, projections arising above the surface of board 12 may be eliminated by recessing the handle retaining means within board 12. In FIGS. 2, 3 and 4, such recessed handle retaining means 51 is illustrated.

FIG. 2 is a perspective view of towing board 12, configured as a knee board, having recessed therein tow handle engaging recess 51. Tow handle 13 is engaged within recess 51 in the manner illustrated in FIGS. 3 and 4. FIG. 4 is a side sectional view along lines 4—4 of FIG. 3. With handle 13 engaged within recess 51, towing forces are exerted directly on tow board 12 in the same manner indicated with respect to discussion of FIGS. 8-10. When the rider has positioned himself on board 12 and adjusted the necessary straps to provide a secure purchase while riding board 12, the rider inserts his fingers in finger clearance 52, grasps handle 13 and pulls thereon. Handle 13 is then disengaged from recess 51 and the towing forces are transmitted directly to the hands of rider 11.

What has been disclosed are means for exerting a towing force on an aquatic recreational towing device in the initial stages of towing the device while a rider thereon positions himself for purposes of riding on and maneuvering the device as it is drawn over a water surface at high speed by a towing boat. The tow rope running between the towing boat and the towed device is coupled directly to the device in a manner which readily permits the rider to decouple the towing force from its direct application to the towing device and to interpose the rider between the tow rope and the towed device as an intermediary means for transmitting towing forces from the tow boat to the towed device.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention, that which is claimed is:

1. In an aquatic recreational system in which a rider holds a tow rope handle and is towed, via a tow rope, through water by a tow boat while mounting an aquatic towing device and rises to a riding and maneuvering position on said towing device as said tow boat gains speed, the improvement comprising:

releasable coupling means fixedly coupled to said towing device for releasably coupling said tow rope to said towing device whereby said device is towed directly by said tow boat without intervention of said rider until said rider assumes tow rope handle control by releasing said coupling between said tow rope and said towing device, wherein said releasable coupling means comprises tow rope handle-retaining means coupled to said towing device for releasedly retaining said tow rope handle in direct towing contact with said towing device;

said tow rope handle retaining means comprises a recess in said towing device of shape complementary to that of said tow rope handle for matingly retaining said handle in direct, releasable towing contact with said towing device; and said towing device comprises an aquatic planing device.

2. The improvement of claim 1 wherein said towing device is a knee board.

3. In an aquatic recreational system in which a rider holds a tow rope handle and is towed, via a tow rope, through water by a tow boat while mounting an aquatic towing device and rises to a riding and maneuvering position on said towing device as said tow boat gains speed, the improvement comprising:

releasable coupling means fixedly coupled to said towing device for releasably coupling said tow rope to said towing device whereby said device is towed directly by said tow boat without intervention of said rider until said rider assumes tow rope handle control by releasing said coupling between said tow rope and said towing device, wherein said releasable coupling means comprises:

a first tow-rope-retaining-means coupled to said towing device; and a second tow-rope-retaining-means coupled to said tow rope proximate said toe rope handle making a releasable coupling with said first tow-rope-retaining: and wherein said first tow-rope-retaining-means comprises a selectedly shaped keyway recessed in said towing device;

said second tow-rope-retaining-means comprises a selectedly shaped key of complementary shape to that of said first toe-rope-retaining-means emplacable within said first tow-rope-retaining-means to be releasedly retained therein; and said towing device comprises an aquatic planing device.

4. The improvement of claim 3 wherein said towing device is a ski board.

5. The improvement of claim 3 wherein said keyway is a tee-shaped keyway.

6. The improvement of claim 5 wherein said key is a tee-shaped key.

7. In an aquatic recreational system in which a rider holds a tow rope handle and is towed, via a tow rope, through water by a tow boat while mounting an aquatic planing, towing device and rises to a riding and maneuvering position on said towing device as said tow boat gains speed, the improvement comprising:

releasable coupling means fixedly coupled to said towing device for coupling said tow rope to said towing device whereby said device is towed directly by said tow boat without intervention of said rider until said rider assumes tow rope handle control by manipulating said tow rope to release said coupling between said tow rope and said towing device;

said releasable coupling means comprising a recess in an upper surface of said towing device for mating with a selectedly shaped device coupled to said tow rope, said recess having a shape complementary to that of said selectedly shaped device for matingly retaining said selectedly shaped device in direct, releasable towing contact with said towing device until said rider so manipulates said towing rope, while being towed, to release said selectedly shaped device from mating retention within said recess;

said releasable coupling means further comprising a said selectedly shaped device coupled to said towing rope.

8. The improvement of claim 7 wherein said selectedly shaped device comprises said tow rope handle.

9. The improvement of claim 7 wherein said selectedly shaped device comprises a selectedly shaped key matingly emplacable within said recess; and said recess comprises a complementarily shaped keyway.

* * * * *